US005126631A

United States Patent [19]

Golz

[11] Patent Number: 5,126,631

[45] Date of Patent: Jun. 30, 1992

[54] CEMENT-TYPE MOUNT FOR A LAMP INCLUDING MEANS FOR PROTECTING THE LAMP EXHAUST-TUBE TIP AGAINST FRACTURE

[75] Inventor: Thomas M. Golz, Willoughby Hills, Ohio

[73] Assignee: General Electric Company, Schenectady, N.Y.

[21] Appl. No.: 630,409

[22] Filed: Dec. 19, 1990

Related U.S. Application Data

[63] Continuation of Ser. No. 382,464, Jul. 20, 1989, abandoned.

[51] Int. Cl.[5] ..... H01J 61/36; H01J 17/16; H01K 1/22

[52] U.S. Cl. ..... 313/634; 313/318; 313/579; 313/580

[58] Field of Search ..... 313/318, 113, 634, 579, 313/580

[56] References Cited

U.S. PATENT DOCUMENTS

| | | | |
|---|---|---|---|
| 586,055 | 7/1897 | Olan | 313/580 X |
| 4,126,810 | 11/1978 | Cox | 313/318 |
| 4,130,774 | 12/1978 | Cosco et al. | 313/318 |

OTHER PUBLICATIONS

Sketch with labels of a mounted lamp delivered by General Electric Company to a purchaser prior to May 15, 1988.

*Primary Examiner*—Sandra L. O'Shea

*Attorney, Agent, or Firm*—George E. Hawranko; Stanley C. Corwin; Fred Jacob

[57] ABSTRACT

For mounting a lamp that comprises a glass envelope including a seal and a glass exhaust tube having a tip projecting from the seal, there is provided a base having a cavity for receiving the seal and the exhaust-tube tip. Within the cavity about the seal and the tip is a hard cement for fixedly positioning the envelope within the cavity. Surrounding the tip and located between the tip and the adjacent cement is a thin layer of soft material that can yield in response to forces developed thereon by thermal expansion and contraction of the cement, thereby protecting the tip from being cracked by these forces. The hard cement extends into contact with the glass seal about a substantial portion of the seal's exterior surface so that the hard cement is able to fixedly position the envelope relative to the base without interference from the softer material about the tip.

9 Claims, 1 Drawing Sheet

Fig. 1
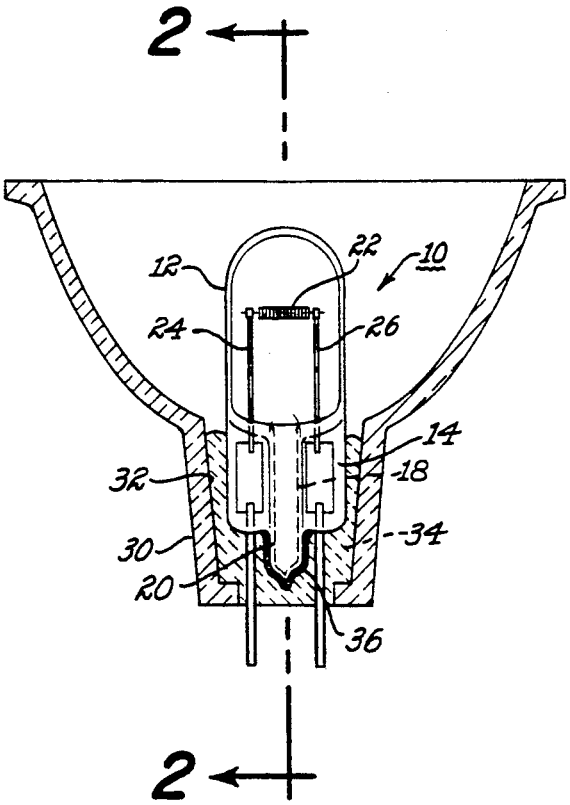
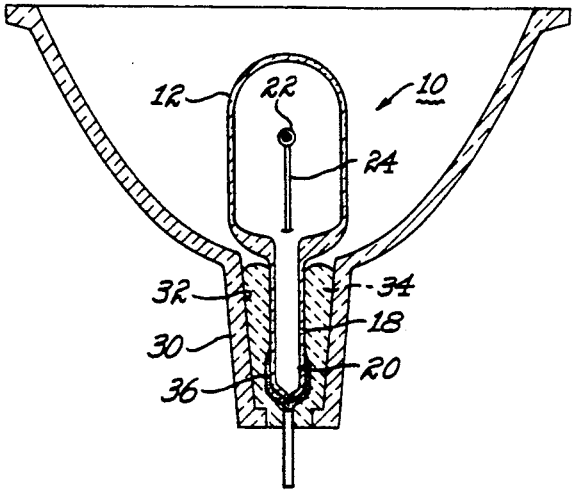
Fig. 2

CEMENT-TYPE MOUNT FOR A LAMP INCLUDING MEANS FOR PROTECTING THE LAMP EXHAUST-TUBE TIP AGAINST FRACTURE

This application is a continuation of application Ser. No. 07/382,464, filed Jul. 20, 1989, now abandoned.

This invention relates to mounting means for a lamp having a glass envelope including a seal and a glass exhaust tube having a relatively fragile tip projecting from the seal and, more particularly, relates to mounting means for this purpose comprising hard cement disposed about the seal and tip and capable of effectively protecting the fragile tip from being cracked by forces developed by thermal expansion and contraction of the cement.

BACKGROUND

Certain miniature lamps include, as part of their glass envelope, a seal and a glass exhaust tube having a tip projecting outwardly from the seal. Such lamps are often mounted in a base by providing within the base a hard ceramic cement that extends about the seal and the relatively fragile tip. The hard cement has the advantageous property of being able to prevent significant movement of the lamp with respect to the base and of being able to function in this manner without impairment by the high temperatures of lamp operation. A problem that arises with this type of mounting is that the cement, during curing and during lamp cycling, develops relatively high forces on the tip as a result of thermal expansion and contraction slightly different from that of the seal and tip. The actual motion of the cement with respect to the tip may be extremely small, e.g., only three millionths of an inch in some lamps, but the resulting force on the small tip even under these conditions can be quite high, e.g., can produce pressures exceeding 5000 psi. Such force can crack the relatively fragile tip, thereby ruining the lamp.

OBJECTS

An object of my invention is to construct the cement-type mounting of such a lamp in such a manner that the exhaust tube tip is effectively protected from being fractured by thermal expansion and contraction forces developed, as during curing of the hard cement or during lamp cycling.

Another object is to provide a hard cement mounting that, despite modification to provide the above-described protection of the exhaust tube tip, still retains its ability to prevent significant movement of the lamp with respect to its base and to withstand the high temperatures of lamp operation.

SUMMARY

In carrying out the invention in one form, I provide a lamp that comprises a glass envelope including a seal and a glass exhaust tube having a tip projecting from the seal. For supporting the envelope, I provide a base having a cavity receiving said seal and glass exhaust-tube tip. Within the cavity and disposed about the seal and the tip is a hard cement that is cured to fixedly position the envelope within the cavity. Surrounding the tip and located between the tip and the adjacent cement is a thin layer of a material softer than the cement, which layer yields in response to forces developed thereon by thermal expansion and contraction of the cement, thereby protecting the tip from being cracked by these forces. The hard cement extends into contact with the glass seal about a substantial portion of the exterior surface of the seal so that the hard cement is able to fixedly position the envelope with respect to the base without interference from the softer material about the tip.

BRIEF DESCRIPTION OF FIGURES

For a better understanding of the invention, reference may be had to the following description taken in conjunction with the accompanying drawing, wherein:

FIG. 1 is a side elevational view of a lamp positioned in a cement-type mounting, with the mounting sectioned more clearly to show its relationship to the lamp envelope. The projecting exhaust tube tip is also shown in section for clarity.

FIG. 2 is a sectional view along the line 2—2 of FIG. 1.

DETAILED DESCRIPTION OF EMBODIMENT

Referring now to FIGS. 1 and 2, there is shown a miniature lamp 10 comprising a glass envelope 12 including at its lower end a pinch seal 14 also of glass and a glass exhaust tube 18 extending through the seal and having a tip 20 at its lowermost end. Within the envelope 12 is a tungsten filament 22 and two spaced-apart lead-in conductors 24 and 26 between the upper ends of which the filament is connected. The lead-in conductors extend from the outside to the inside of the envelope through the pinch seal 14 and in sealed relationship to the glass of the seal.

For mounting the lamp 10 in a precisely fixed position relative to a reflector (not shown), there is provided a ceramic base 30 that is suitably fixed to the reflector. This base 30 contains a cavity 32 in which the pinch seal portion 14 of the envelope is located. The space between the seal portion 14 and the interior of the cavity 323 is filled with a hard ceramic cement 4. A suitable lamp-basing cement for this purpose is a cement available, for example, from the Sauereisen Cements Company, Pittsburgh, Pa., as its #33 cement, or other ceramic cements known to the industry.

In conventional lamp mounting, the hard cement 34 fills the entire space between the pinch seal 14 and the surrounding cavity 32 and is in intimate contact with the pinch seal and the tip 20 of the exhaust tube. The cement is introduced into this space in an uncured, plastic condition, following which it is cured into a hard condition with the assistance of heat applied to the ceramic base 30.

The cement expands and contracts both during the curing operation and during lamp cycling, primarily as a result of heating and cooling. While the cement may be selected to have a coefficient of thermal expansion substantially matching that of the glass of the seal 14 and the tip 20, there is still some slight motion of the cement relative to this glass during these temperature excursions. Though this relative motion may be very small, e.g., only three millionths of an inch in some lamp mountings, very high forces, e.g., producing pressures of 5000 psi or more, can be developed on the glass, particularly the relatively fragile tip. These forces can sometimes fracture the tip and thereby ruin the lamp.

For protecting the tip 20 against these forces, I provide, in one embodiment of my invention, a thin coating 36 of a material much softer than the cured cement 34 about the tip 20. In one specific embodiment, I have used for this coating 36 a thin layer of silicon rubber applied to the tip by painting or dipping. In another specific embodiment, I use a thin slip-on tube of polyfluoroethylene, a material available from E. I. duPont as its Teflon material. Other materials may also be used provided they are softer than the cement and are capable of staying in place on the tip until the cement cures to maintain its own gap, and provided further that they do not harm the lamp function (as by smoking, melting, shorting, or the like during lamp operation). The coating 36 is applied to the tip before the cavity 32 is filled with the cement 34 and preferably remains in place during curing of the cement and thereafter. In the illustrated form of the invention, the coating 36 completely fills the entire space between the tip 20 and the surrounding cement. The coating receives any forces developed on the tip as a result of relative motion between the surrounding cement and the tip resulting from thermal expansion or contraction of the cement: and the coating yields slightly in response to such forces, thereby protecting the tip from being cracked by these forces.

In its broader aspects, the invention comprehends the use of a material around the tip which vaporizes during curing, or during other intervals when high temperatures are developed, to leave a small gap between the tip 20 and the surrounding cement. An example of such a material is nitrocellulose, which breaks down at about 180° C.

In each of these embodiments, the tip 20 is effectively decoupled, or isolated, from the surrounding cement 34 so that the cement is free to expand and contract in response to temperature changes without imposing intolerable loads on the tip.

Since the hard cement is in direct contact with the exterior surface of the seal portion 14 of the lamp envelope about the entire periphery of the seal portion the lamp is rigidly fixed with respect to the base 30 and is not free to move with respect to the base; and such rigid fixation of the envelope is present even though the thickness of the yieldable layer 36 might substantially exceed that illustrated. In other words, the maximum thickness of coating 36 is not critical and can be varied within reasonable limits without affecting the ability of the mounting to rigidly fix the envelope. Preferably, the hard cement contacts the seal portion 14 about substantially the entire exterior surface of the seal portion, excluding the tip 20, that is located within the cement. Thus, the incorporation of the thin layer 36 on the tip does not detract from the capability of the hard cement to precisely fix the lamp within the base 30. Nor does the presence of soft layer 36 detract from the ability of the cement to withstand the high temperatures of lamp operation and to continue its function of precisely fixing the lamp within the base 30. One type of ceramic cement 34 which I use in my mounting can withstand temperatures up to 400° C. without deterioration, whereas the maximum temperatures developed in the cement by most lamps for this application is in the neighborhood of 200° C.

Fixedly positioning the lamp within its base and, hence, within a surrounding reflector in which the base typically is fixed, is important in numerous lamp applications, especially where it is required that the light source remain fixed and precisely located with respect to the reflector. There is typically a greater sensitivity to small movements of the source with respect to the reflector where the source itself is small, e.g., a few millimeters or less in external dimension. Examples of such applications are miniature lamps for microscopes and other precision apparatus, lamps for miners' lights, and certain display lamps.

While I have shown and described a particular embodiment of my invention, it will be obvious to those skilled in the art that various changes and modifications may be made without departing from my invention in its broader aspect; and I, therefore, intend in the appended claims to cover all such changes and modifications as fall within the true spirit and scope of my invention.

What I claim as new and desire to secure by Letters Patent of the United States is:

1. In combination, (a) a lamp comprising a glass envelope including a seal and a glass exhaust tube having a tip projecting from said seal, (b) a support for said envelope having a cavity receiving said seal and glass exhaust-tube tip, (c) a hard cement within said cavity disposed about said seal and said exhaust-tube tip for fixedly positioning said envelope with respect to said support, (d) a layer of a material softer than said cement surrounding said projecting exhaust-tube tip and located between said tip and said cement for protecting said tip from cracking in response to thermal expansion and contraction of said cement as may occur during curing of said hard cement and during cycling of said lamp, (e) said hard cement extending into contact with said glass seal about a substantial portion of the exterior surface of said seal so that the ability of said hard cement to fixedly position said envelope with respect to said base is unaffected by the presence of said layer of softer material and (f) wherein said projecting exhaust tube tip extends from said glass envelope in a defined, non-tapered manner.

2. The combination of claim 1 in which said hard cement contacts the exterior surface of said glass seal about substantially the entire outer periphery of said glass seal.

3. The combination of claim 1 in which said layer of softer material substantially completely fills the space between said tip and said hard cement.

4. The combination of claim 1 in which said layer of softer material is of silicon rubber.

5. The combination of claim 1 in which said layer of softer material is constituted by a preformed slip-on tube.

6. The combination of claim 1 in which said layer of softer material is constituted by a slip-on tube of fluorocarbon resin.

7. The combination of claim 1 wherein said glass envelope includes a substantially flat lower portion and said projecting exhaust tube tip extends therefrom.

8. In combination, (a) a lamp comprising a glass envelope including a seal and a glass exhaust tube having a tip projecting from said seal, (b) a support for said envelope having a cavity receiving said seal and glass exhaust-tube tip, (c) a hard cement within said cavity disposed about said seal and said exhaust-tube tip for fixedly positioning said envelope with respect to said support, and (d) isolating means surrounding said exhaust-tube tip and located between said tip and said cement for isolating said tip from otherwise damaging forces produced by thermal expansion and contraction of said cement during curing and lamp cycling, thereby protecting said tip from being cracked by said forces, and (e) said hard cement extending into contact with said seal about a substantial portion of the exterior surface of said seal so that the ability of said hard cement to fixedly position said envelope with respect to said base is not interfered with by the presence of said isolating means.

9. The combination of claim 7 in which said hard cement contacts the exterior surface of said glass seal about substantially the entire outer periphery of said glass seal.

* * * * *